US008638266B2

(12) United States Patent
Liu et al.

(10) Patent No.: US 8,638,266 B2
(45) Date of Patent: Jan. 28, 2014

(54) ANTENNA ARRANGEMENT AND A RADIO APPARATUS INCLUDING THE ANTENNA ARRANGEMENT

(75) Inventors: Zidong Liu, Dorset (GB); Kevin Boyle, Horsham (GB)

(73) Assignee: NXP, B.V., Eindhoven (NL)

( * ) Notice: Subject to any disclaimer, the term of this patent is extended or adjusted under 35 U.S.C. 154(b) by 340 days.

(21) Appl. No.: 13/055,173

(22) PCT Filed: Jul. 23, 2009

(86) PCT No.: PCT/IB2009/053210

§ 371 (c)(1),
(2), (4) Date: Apr. 14, 2011

(87) PCT Pub. No.: WO2010/010529

PCT Pub. Date: Jan. 28, 2010

(65) Prior Publication Data

US 2011/0193758 A1 Aug. 11, 2011

(30) Foreign Application Priority Data

Jul. 24, 2008 (EP) ..... 08104868

(51) Int. Cl.
*H01Q 13/10* (2006.01)

(52) U.S. Cl.
USPC ..... 343/767

(58) Field of Classification Search
USPC ..... 343/767, 770, 700 MS
See application file for complete search history.

(56) References Cited

U.S. PATENT DOCUMENTS

| | | | | |
|---|---|---|---|---|
| 6,252,552 | B1 | 6/2001 | Tarvas et al. | |
| 6,831,607 | B2 * | 12/2004 | Hebron et al. | 343/700 MS |
| 6,911,945 | B2 * | 6/2005 | Korva | 343/702 |
| 6,930,642 | B2 * | 8/2005 | Kossiavas et al. | 343/702 |
| 7,106,257 | B2 * | 9/2006 | Liu et al. | 343/700 MS |
| 8,350,761 | B2 * | 1/2013 | Hill et al. | 343/702 |

(Continued)

FOREIGN PATENT DOCUMENTS

| | | | |
|---|---|---|---|
| EP | 0 795 926 | A2 | 9/1997 |
| WO | 2004/102744 | A1 | 11/2004 |
| WO | 2005/109567 | A1 | 11/2005 |
| WO | 2006/042562 | A1 | 4/2006 |
| WO | 2006/114477 | A1 | 11/2006 |

OTHER PUBLICATIONS

Massey, P. J. et al. "Optimised UWB Notch Antennas for Miniaturised Consumer Electronics Applications" IEEE The Institution of Engineering and Technology Seminar on Ultra Wideband Systems, Technologies and Applications, 5 pgs (Apr. 2006).

(Continued)

*Primary Examiner* — Seung Lee

(57) ABSTRACT

An antenna arrangement comprises a ground plane (14) and a planar antenna element (30) mounted spaced from and parallel to the ground plane. An open-ended slot (16) is provided in the ground plane (14), the slot being coextensive with an edge portion of the ground plane and having a first end (18) opening into the edge portion of the ground plane and a second closed end (20). An antenna feed (22) is coupled to the slot at a location intermediate the first and second ends. The planar antenna element is connected by an electrically conductive wall (28) to the edge portion of the ground plane, the wall (28) being coextensive with the slot (16). The combination of the slot shape, slot location and the wall serves to increase the bandwidth of the antenna arrangement.

10 Claims, 6 Drawing Sheets

(56) References Cited

U.S. PATENT DOCUMENTS

Figure 1:
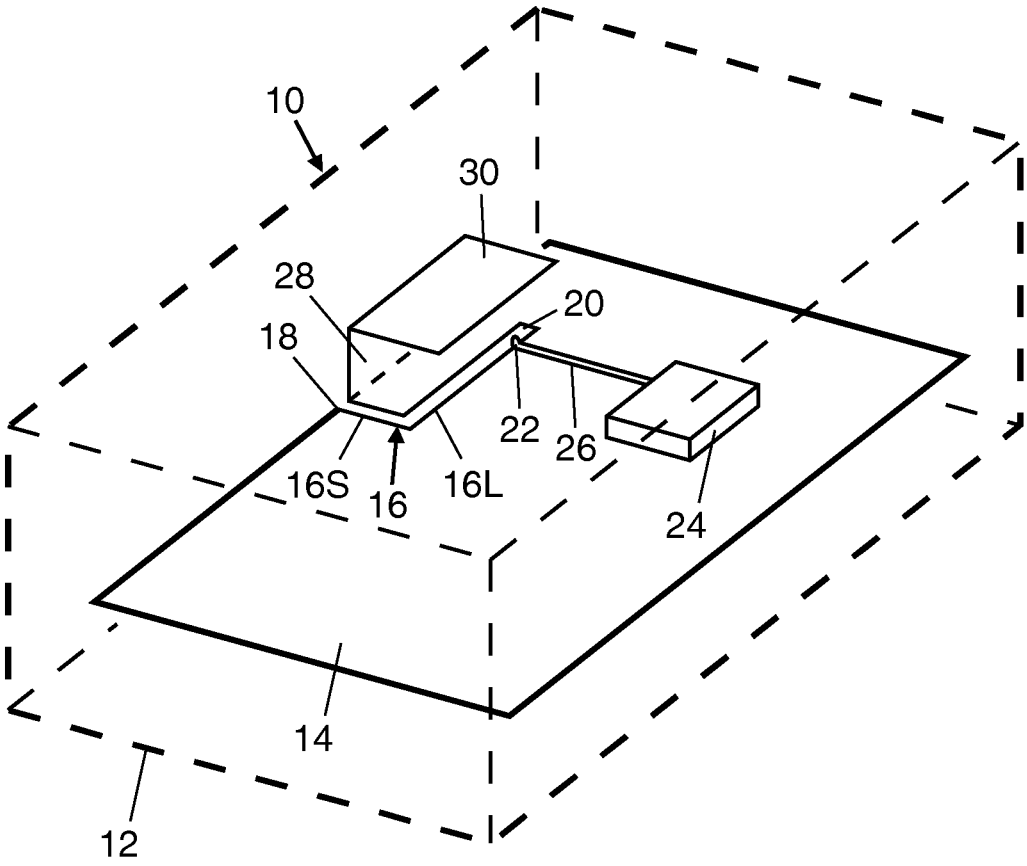

| | | | | |
|---|---|---|---|---|
| 2003/0189525 | A1* | 10/2003 | Tan et al. | 343/767 |
| 2004/0058723 | A1* | 3/2004 | Mikkola et al. | 455/575.7 |
| 2004/0137971 | A1* | 7/2004 | Shoji | 455/575.5 |
| 2005/0243006 | A1 | 11/2005 | Lin et al. | |
| 2005/0259024 | A1 | 11/2005 | Hung et al. | |
| 2006/0055606 | A1* | 3/2006 | Boyle | 343/702 |
| 2007/0040751 | A1* | 2/2007 | Boyle | 343/702 |
| 2008/0165065 | A1 | 7/2008 | Hill et al. | |

OTHER PUBLICATIONS

Massey, P. J. "Making Quarter Wavelength Notch Antennas Wideband" Piers Online, vol. 3, No. 7, pp. 984-986 (2007).

Liu, Z. et al. "MEMS-Switched, Frequency-Tunable Hybrid Slot/PIFA Antenna", IEEE Antennas and Wireless Propagation Letters, vol. 8, pp. 311-314 (2009).

International Search Report for Patent Appl. No. PCT/IB2009/053210 (Feb. 2, 2010).

* cited by examiner

ANTENNA ARRANGEMENT AND A RADIO APPARATUS INCLUDING THE ANTENNA ARRANGEMENT

The present invention relates to an antenna arrangement and to a radio apparatus including the antenna arrangement. The present invention has particular, but not exclusive application, to multiband cellular telephones.

Modern compact cellular telephones normally include an internal antenna of which a planar inverted-F antenna (PIFA) is an example. Typically a PIFA comprises a ground plane and a planar antenna element mounted spaced from, and parallel to, the ground plane. The planar antenna element has a ground connection coupled to the ground plane and a separate RF feed connection coupled to a RF output/input coupling of an RF section of the cellular telephone. An open ended slot may be provided in the planar antenna element at a location intermediate the ground and RF feed connections to enable the antenna arrangement to have two resonances in order to facilitate dual band operation.

The following articles disclose wideband notch antennas: Making Quarter Wavelength Notch Antennas Wideband, Peter J Massey, Kevin R. Boyle, A. J. M. De Grauw, M. Udink, and D. L. Raynes, PIERS 2007, 26-30 Mar. 2007, and Optimised UWB notch antennas for miniaturised consumer electronics applications, P. J. Massey, K. R. Boyle, A. de Graauw, M. Udink, D. L. Raynes, IEE Seminar on Ultra Wideband Systems, Technologies and Applications, Savoy Place, London, UK, 20 Apr. 2006.

An object of the present invention is to widen the operating bandwidth of a planar antenna arrangement.

According to a first aspect of the present invention there is provided an antenna arrangement comprising a ground plane and a planar antenna element mounted spaced from and parallel to the ground plane, wherein a slot is provided in the ground plane, the slot being coextensive with an edge portion of the ground plane and having a first end opening into the edge portion of the ground plane and a second closed end, an antenna feed coupled to the slot at a location intermediate the first and second ends, and wherein the planar antenna element is connected by an electrically conductive wall to the edge portion of the ground plane, the wall being co-extensive with the slot.

According to a second aspect of the present invention there is provided a radio apparatus having an antenna arrangement comprising a ground plane and a planar antenna element mounted spaced from and parallel to the ground plane, wherein a slot is provided in the ground plane, the slot being coextensive with an edge portion of the ground plane and having a first end opening into the edge portion of the ground plane and a second closed end, an antenna feed coupled to the slot at a location intermediate the first and second ends, wherein the planar antenna element is connected by an electrically conductive wall to the edge portion of the ground plane, the wall being co-extensive with the slot and wherein a RF module is provided, the RF module having an output/input coupling for connection to the antenna feed.

If desired the slot in the ground plane may be a L-shaped parallel sided slot having a shorter portion and a longer portion with the first end is provided in the shorter portion. Alternatively the slot may have a shaped portion which converges from its first end towards its second end. The open first end of the slot may be located in a region of the edge of the ground plane away from the marginal portions of the ground plane. For convenience the edge portion of the ground plane is straight.

In an embodiment of the present invention the length of the slot between its first and second ends is substantially a quarter of a wavelength of a frequency in a frequency band of interest.

The slot may be tunable by antenna tuning means.

The ground plane may comprise a printed circuit board (PCB) on which the RF module comprising transmitting/receiving circuitry is provided.

In another embodiment of the present invention a second wall is connected to the ground plane and extends from the opposite side of the first end of the slot.

By providing the electrically conductive wall, for example a metallic wall, in a close vicinity of the open ended slot antenna, the wall substantially increases the bandwidth of the slot antenna to an extent that a larger total bandwidth coverage can be achieved than with a conventional slot antenna.

By providing the slot in the ground plane a simpler and more practical antenna tuning circuit can be used if it is desired to cover a very wide band with frequency tuning.

Specific shaping of the slot has been found to increase the bandwidth potential of the antenna arrangement made in accordance with the present invention. Additionally the antenna arrangement may be implemented at various locations of a mobile phone PCB other than only at the corners of or at the top or bottom of the PCB. A more simplified tuning circuit may be used.

The wall does not operate similarly to and is not designed the same way as a conventional resonant parasitic element.

If desired the wall may be implemented by integrating it as part of a mobile telephone mechanics/chassis.

The antenna arrangement made in accordance with the present invention provides a good compromise between bandwidth and Specific Absorption Rate (SAR). This is attributed to the co-design of the slot shape, slot location and the electrically conductive wall.

Figure 2:
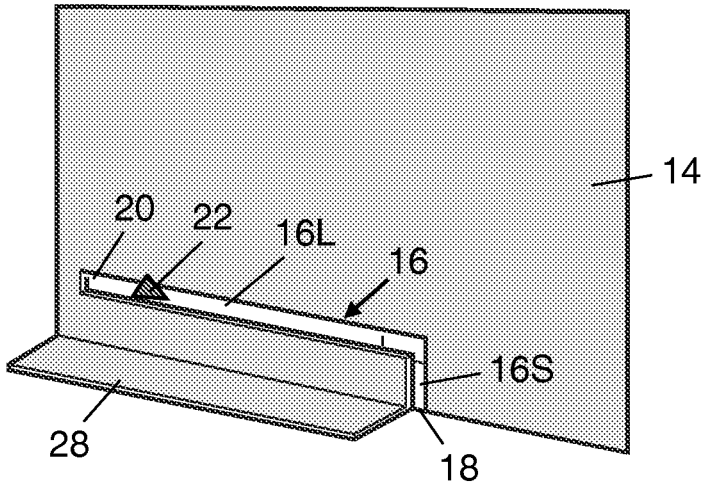
Figure 3:
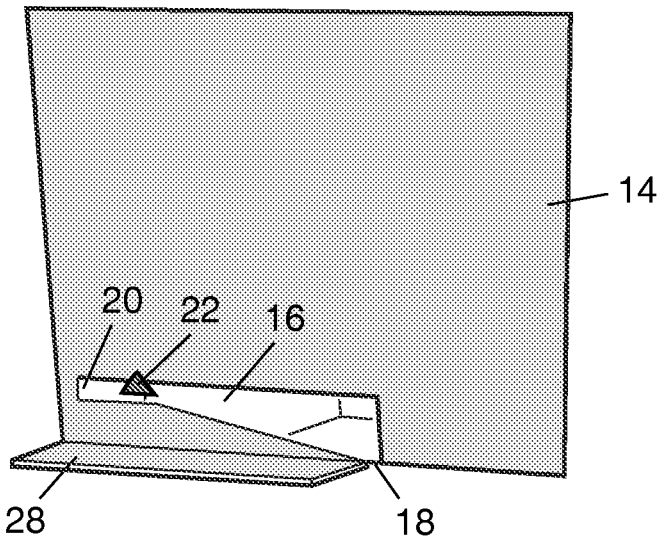
Figure 4:
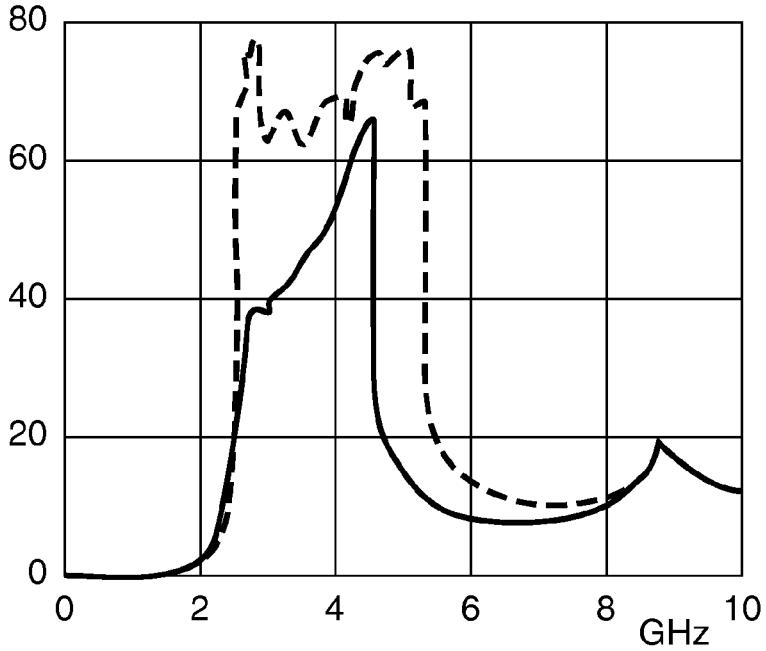
Figure 5:
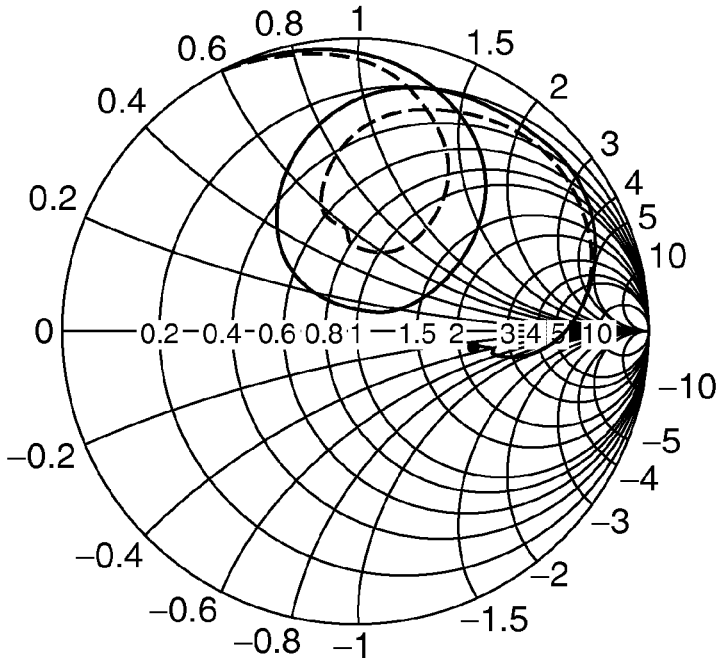
Figure 6:
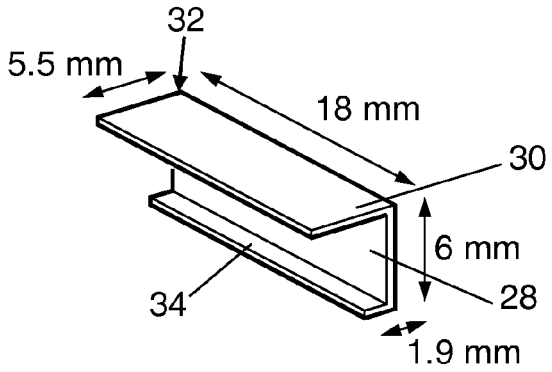
Figure 7:
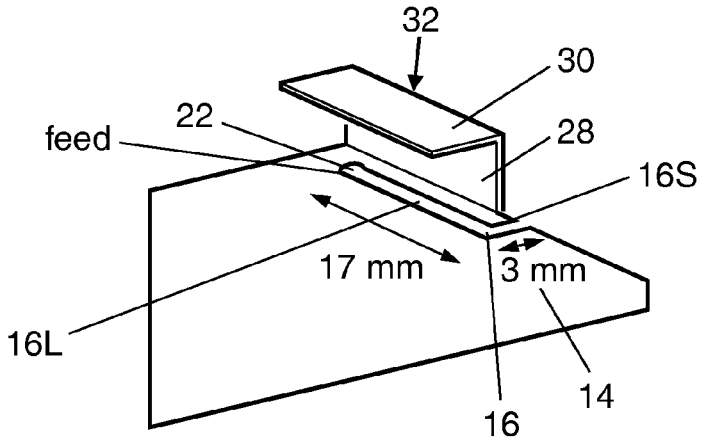
Figure 8:
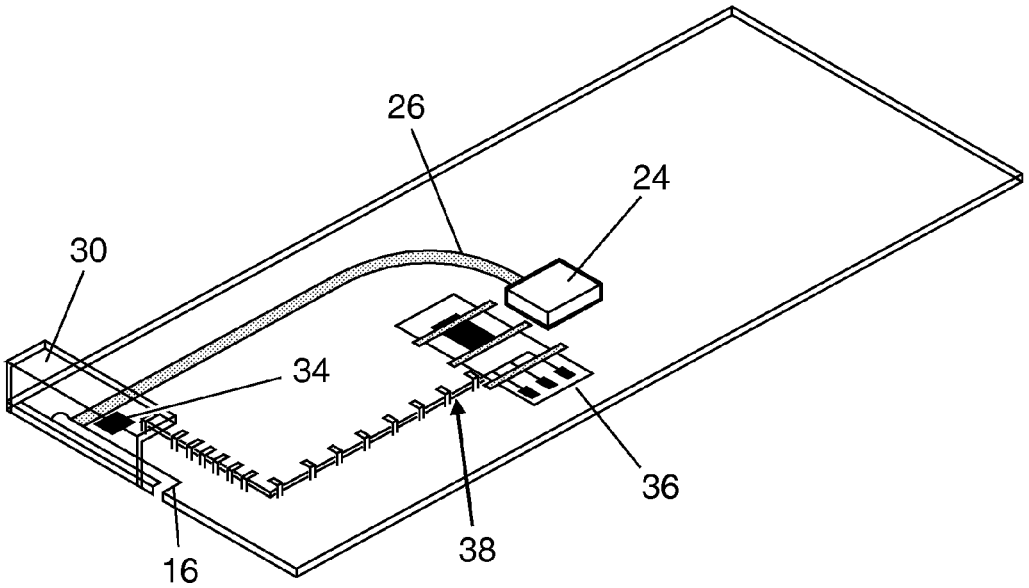
Figure 9:
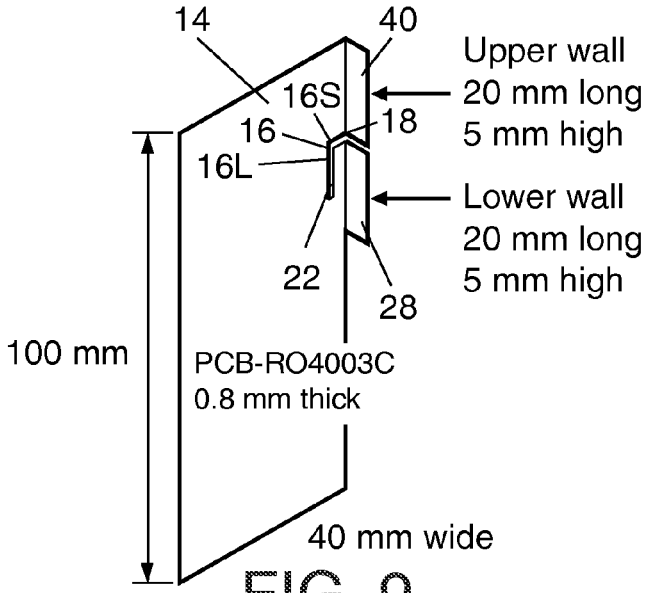
Figure 10:
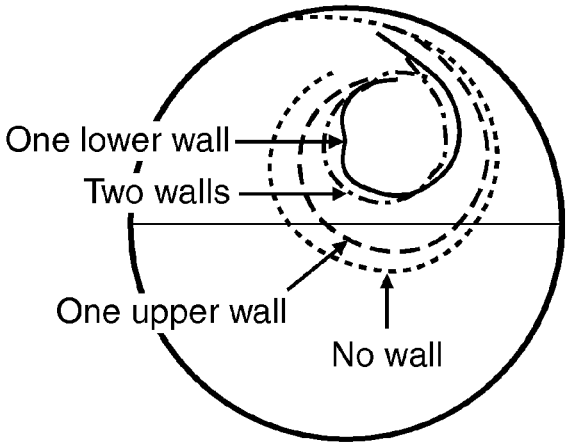
Figure 11:
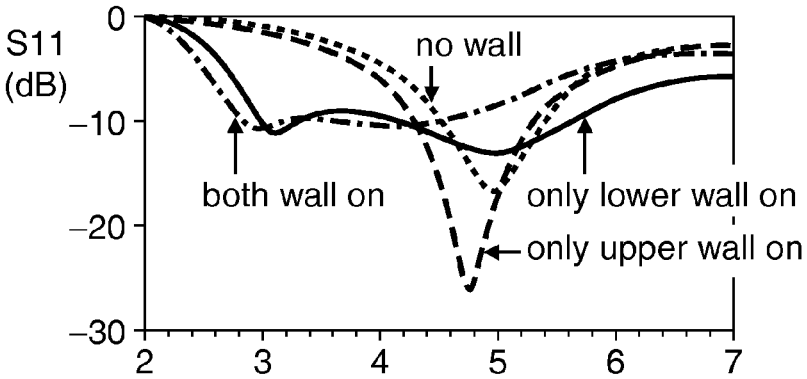
Figure 12:
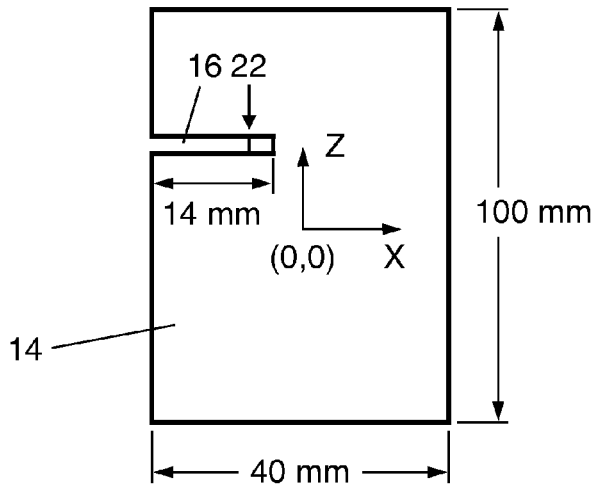
Figure 13:
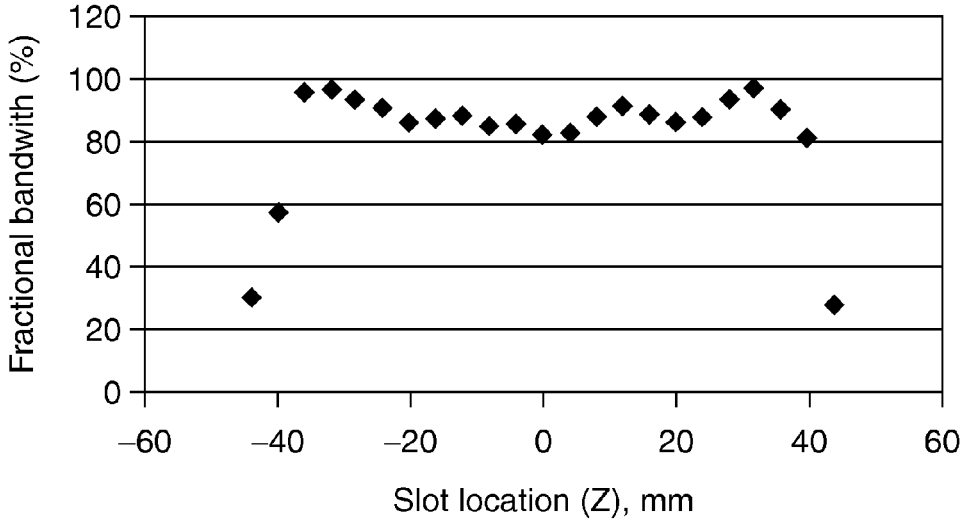

The present invention will now be described, by way of example, with reference to the accompanying drawings, wherein:

FIG. 1 is a diagrammatic view of a portable radio apparatus having an antenna arrangement made in accordance with the present invention, FIG. 2 is a diagrammatic view of a PCB comprising an L-shaped slot antenna with a wall but, for the sake of clarity, omitting the planar antenna element, FIG. 3 is a diagrammatic view of a PCB comprising a shaped slot antenna with a wall but, for the sake of clarity, omitting the planar antenna element, FIG. 4 shows graphs comparing the performances of a L-shaped slot (continuous line) and a shaped slot of the type shown in FIG. 3 (broken lines), FIG. 5 is a S-parameter Smith chart comparing the performances of a L-shaped slot (continuous line) and a shaped slot of the type shown in FIG. 3 (broken lines), FIG. 6 is a perspective view of an assembly comprising a planar antenna element and the wall, FIG. 7 is a perspective view of the assembly of a planar antenna element and the wall mounted on a PCB, FIG. 8 is a diagrammatic view of a tunable antenna arrangement made in accordance with the present invention, FIG. 9 shows diagrammatically a PCB having a second wall located on the opposite side of the opening to the slot in the PCB, FIG. 10 is a Smith chart showing the effects of having no wall and either one or both of the walls shown in FIG. 9, FIG. 11 shows graphs comparing the performances of not having a wall and either one or both of the walls shown in FIG. 9, FIG. 12 is a diagram of a test piece showing a ground plane having a single open ended slot, and FIG. 13 is a graph illustrating the variations in fractional bandwidth for different slot locations.

In the drawings the same reference numerals having been used to indicate the same features.

FIG. 1 shows a simplified view of a radio apparatus 10, for example a cellular telephone, comprising a housing 12 containing a ground plane 14 in the form of a printed circuit board (PCB). For the sake of clarity normal features of a cellular telephone, such as a keypad, display screen, microphone port and earphone port, have not been shown. A quarter wavelength open ended L-shaped antenna slot 16 is provided in the ground plane 14. The antenna slot 16 comprises a shorter portion 16S and a longer portion 16L. The longer portion 16L extends substantially parallel to, but is spaced from, an edge portion of the ground plane. The shorter portion 16S has an opening 18 in the edge of the ground plane located in the central region of the edge. The longer portion 16L has a closed end 20. An antenna feed 22 is provided across the longer portion 16L of the slot 16 at a location spaced from the closed end 20. A RF module 24 comprising transmitting and receiving circuitry (not shown) is mounted on the ground plane and is coupled to the feed point 22 by way of a coaxial line or stripline 26. A planar antenna element 30 is mounted above the slot 16 in the ground plane 14 by means of an electrically conductive, for example metallic, wall 28 attached to the edge portion of the ground plane 14 adjacent the slot 16. For convenience of manufacture the edge portion of the ground plane is straight but it could be curved.

FIG. 2 illustrates the ground plane 14 having a quarter wavelength L-shaped open ended slot 16 and the wall 28 having a length which is greater than that of the longer portion 16L of the slot. In operation, RF energy supplied to the feed point 22 causes a current to flow around the closed end 20 of the slot 16. This will produce a first resonance. The wall 28 removes a constraint on the current flowing around the closed end 20 of the slot 16 and the current flowing in the wall provides a second resonance.

FIG. 3 illustrates a variant of FIG. 2 in that the shape of the slot has been given a shaped design different from the L-shape shown in FIG. 2. In the example shown in FIG. 3 the slot converges continuously from its open end 18 towards the feed point 28 and thereafter it is parallel to the closed end 20. The slot has a length equal to a quarter wave of the frequency of interest. As will be described with reference to FIGS. 4 and 5 shaping of the slot 16 enhances the bandwidth of the antenna arrangement.

FIGS. 4 and 5 show the performance of the L-shaped slot as a continuous line and that of the shaped slot as a broken line. In the case of FIG. 4 which is a plot of bandwidth potential in percent against frequency between 0 Ghz and 10 GHz the frequency response of the shaped slot extends to a higher frequency and has a higher percentage bandwidth overall. In the case of the Smith chart show in FIG. 5 the impedance locus is clearly smaller with the shaped slot design as compared to the L-shaped version.

FIG. 6 illustrates an embodiment of a sub-assembly 32 comprising the wall 28 and the planar antenna element 30. The planar antenna element 30 is of rectangular shape having a length of 18 mm and a width of 5.5 mm. The wall is 18 mm long and has a height of 6 mm. A narrow in-turned edge 34 of a width 1.9 mm provides a means for mounting the sub-assembly 32 on the ground plane 14.

FIG. 7 shows the sub-assembly 32 mounted along the top edge of the ground plane 14 and the open end 18 of the L-shaped slot 16 being located in the central portion of the ground plane 14. In the illustrated example the overall length of the slot 16 is 20 mm with the shorter portion 16S being 3 mm and the longer the portion 16L being 17 mm.

FIG. 8 illustrates an antenna arrangement which is tunable by components 34 coupled to the antenna feed. Typically the tuning is effected by means of Micro Electromagnetic Systems (MEMS) switches controlled by digital switches 36 causing devices such as capacitances and/or inductances to be connected to the antenna feed. Each of the digital switches 36 is connected to a respective MEMS device by a respective dc line 38 located in an elongate slot in the ground plane. Metal bars ground the elongate slot at intervals to prevent it from acting as an antenna slot.

FIG. 9 illustrates a test piece for investigating the bandwidth enhancement using one or two walls along the edge of the ground plane 14. As shown the slot 16 is a L-shaped slot and a first or lower wall 28 extends alongside the longer portion 16L of the slot. A second or upper wall 40 extends from the opposite side of the open end 18 of the slot 16 in a direction away from the open end 18. The dimensions of the upper wall 40 corresponds to those of the wall 28, namely, 20 mm long and 5 mm high. The ground plane 14 comprises a rectangular 0.8 mm thick PCB: R04003C having a length of 100 mm and a width of 40 mm. The S parameter Smith chart shown in FIG. 10 shows the impedance characteristics over a frequency range 1.5 GHz to 6.5 GHz and the S11 chart shown in FIG. 11 show the different impedance characteristics over a frequency range of 2 GHz to 7 GHz. The respective lines are as follows: dotted—no walls; continuous—one lower wall 28; broken—one upper wall 40; and chain/dot—both walls 28, 40. The results show that the lower wall 28 increases the antenna bandwidth and no additional advantage is achieved by adding the upper wall 40.

Finally FIGS. 12 and 13 relate to the results of an investigation into the location of the slot 16. In this investigation the slot was 14 mm long and extended orthogonally to the edge of the ground plane 14. Different positions of the slot in the vertical Z plane with reference to a reference point were considered. FIG. 13 is a graph of fractional bandwidth in percent plotted against slot location, 0 representing the reference point. It will be deduced from FIG. 13 that in order to obtain an acceptable fractional bandwidth the open end 18 of the slot 16 should be located in a region of the edge portion of the ground plane 14 away from the marginal portions of the ground plane, that is not near the corners.

In the present specification and claims the word "a" or "an" preceding an element does not exclude the presence of a plurality of such elements. Further, the word "comprising" does not exclude the presence of other elements or steps than those listed. The use of any reference signs placed between parentheses in the claims shall not be construed as limiting the scope of the claims.

From reading the present disclosure, other modifications will be apparent to persons skilled in the art. Such modifications may involve other features which are already known in the design, manufacture and use of antenna arrangements and component parts therefor and which may be used instead of or in addition to features already described herein.

The invention claimed is:

1. An antenna arrangement comprising:

a ground plane and a planar antenna element mounted spaced from and parallel to the ground plane, wherein a slot is provided in the ground plane, the slot being coextensive with an edge portion of the ground plane and having a first end opening into the edge portion of the ground plane and a second closed end, an antenna feed coupled to the slot at a location intermediate the first and second ends, and wherein the planar antenna element is connected by an electrically conductive wall to the edge portion of the ground plane, the wall being co-extensive with the slot.

2. An antenna arrangement as claimed in claim 1, wherein the slot is a L-shaped parallel sided slot having a shorter portion and a longer portion, and in that the first end is provided in the shorter portion.

3. An antenna arrangement as claimed in claim 1, wherein the slot has a portion which converges from its first end towards its second end.

4. An antenna arrangement as claimed in claim 1, wherein the edge portion of the ground plane is straight.

5. An antenna arrangement as claimed in claim 1, wherein a length of the slot between its first and second ends is substantially a quarter of a wavelength of a frequency in a frequency band of interest.

6. An antenna arrangement as claimed in claim 1, further comprising a tuner for tuning the slot.

7. An antenna arrangement as claimed in claim 1, wherein the ground plane comprises a printed circuit board.

8. An antenna arrangement as claimed in claim 1, further comprising a second wall connected to the ground plane and extending from the opposite side of the first end of the slot.

9. An antenna arrangement as claimed in claim 1, wherein the first open end of the slot opens into a region of the edge of the ground plane away from the marginal portions of the ground plane.

10. A radio apparatus having an antenna arrangement comprising:

a ground plane and a planar antenna element mounted spaced from and parallel to the ground plane, wherein a slot is provided in the ground plane, the slot being coextensive with an edge portion of the ground plane and having a first end opening into the edge portion of the ground plane and a second closed end an antenna feed coupled to the slot at a location intermediate the first and second ends, wherein the planar antenna element is connected by an electrically conductive wall to the edge portion of the ground plane, the wall being co-extensive with the slot and wherein a RF module is provided, the RF module having an output/input coupling for connection to the antenna feed.

* * * * *